US005953865A

United States Patent [19]

Rickards

[11] Patent Number: 5,953,865

[45] Date of Patent: Sep. 21, 1999

[54] CONCEALED NICHE FASTNER

[76] Inventor: John W. Rickards, 3459 Hancock St., San Diego, Calif. 92110

[21] Appl. No.: 08/958,623

[22] Filed: Oct. 27, 1997

[51] Int. Cl.[6] ..... E04B 1/38; E04H 13/00

[52] U.S. Cl. ..... 52/139; 52/509; 52/512; 52/235

[58] Field of Search ..... 52/139, 508, 509, 52/263, 126.6, 506.08, 235, 512

[56] References Cited

U.S. PATENT DOCUMENTS

| | | | |
|---|---|---|---|
| 3,181,664 | 5/1965 | Aagaard | 52/509 X |
| 3,778,942 | 12/1973 | Bondi | 52/509 X |
| 3,828,508 | 8/1974 | Moeller | 52/506.08 X |
| 3,905,169 | 9/1975 | Gallo | 52/137 |
| 4,021,989 | 5/1977 | Hala | 52/713 |
| 4,519,173 | 5/1985 | Roberts | 52/509 X |
| 4,523,413 | 6/1985 | Koppenberg | 52/509 X |
| 4,638,618 | 1/1987 | Iesaka et al. | 52/509 |
| 4,724,643 | 2/1988 | Marsh | 52/509 |
| 5,280,690 | 1/1994 | Hu | 52/513 |

FOREIGN PATENT DOCUMENTS

| | | | |
|---|---|---|---|
| 523733 | 7/1940 | United Kingdom | 52/509 |

*Primary Examiner*—Carl D. Friedman
*Assistant Examiner*—Winnie S. Yip
*Attorney, Agent, or Firm*—Henri J. A. Charmasson; John D. Buchaca

[57] ABSTRACT

A device for releasably fastening a cover slab to the opening of a crypt or niche extending back from a vertical support wall. Each device is positioned at a common point of adjacency of a plurality of slabs. Each device has a rotatively mounted locking plate for engaging slots in the sides of each of the slabs. The plate has a cutaway sized and dimensioned to allow for the passage of one of the slabs through the cutaway when the cutaway is rotated into proper alignment. Keyed tool means for turning the plate indicated the positioning of the cutaway.

11 Claims, 6 Drawing Sheets

CONCEALED NICHE FASTNER

FIELD OF THE INVENTION

This invention relates to mechanical support structures and more particularly to structures for releasably hanging niche and crypt slabs in mausoleums.

BACKGROUND OF THE INVENTION

Most societies have created facilities or repositories such as cemeteries and mausoleums for interring the bodily or cremated remains of persons after death. Remains are often kept in openable chambers set into vertical support walls. Larger chambers, often called crypts are dimensioned to inter bodily remains, while smaller chambers, often called niches are sized to inter cremated remains. To save space, the chambers are often rectangular and arranged in row and column fashion along a single vertical wall. The chamber openings are typically covered by a rectangular block or slab. It is fashionable to use heavy, ornate, rock-based materials such as marble, granite or slate for the slabs.

Because a particular slab must occasionally be removed in order to access or add to the contents of a chamber, the slab is releasably hung or attached over the opening to the chamber using a plurality of slab fasteners.

Various slab fasteners have been developed. One popular approach is described in Gallo, U.S. Pat. No. 3,905,169 utilizing horizontal shelving plates for supporting the weight of the slab while a four removable screw-based rosettes placed at the corners prevent forward movement of the slab. This approach offers some disadvantages including wear or discoloration of the visible forward face of the slab surrounding the rosette. Further, removal of the screw-based rosettes is time-consuming. Since a single rosette can fasten the corners of four corner-adjacent slabs, removal of a rosette can cause an unwanted disruption of the fastening of adjacent slabs.

A move toward hidden means for attachment has been gathering popularity. This allows the outer face of the slab to remain unencumbered or potentially damaged by visible attachment means. One example, disclosed in Hala, U.S. Pat. No. 4,021,989 has a laterally adjustable disc-shaped stone anchor which engages lateral slots machined into the sides of the slab. This design suffers from the problematic securing of closely adjacent slabs, and the penetrative machining of the slots. Another example, disclosed in Hu, U.S. Pat. No. 5,280,690 uses rearwardly extending resilient prongs secured to the back of the slab which releasably penetrate holes in a receptor set into the forward face of the support wall. This design suffers from likely inadequate support for heavier slabs, precise placement of the prongs, and awkward removal.

The invention results from an attempt to develop a hidden slab fastener which reduces or avoids the above identified disadvantages.

SUMMARY OF THE INVENTION

The principal and secondary objects of this invention are to provide an inexpensive durable and hidden slab fastener which provides adequate support, requires a minimum of slab machining, maintains the fastening of adjacent slabs during removal of a slab, and allows for more rapid and simplified removal and replacement of a slab. It is another object of the invention to provide means for indicating the locking condition of a hidden fastener.

These and other valuable objects are provided by a slab fastener comprising a rotatively mounted locking plate located at a common point of adjacency between a plurality of adjacent slabs. The plate is oriented coplanar with the slabs, and sized to engage a slot in the corner sides of each of the slabs. The plate has a cutaway sized and dimensioned to allow for the passage of one of the slabs through the cutaway when the cutaway is rotated into proper alignment. Keyed tool means for turning the plate indicate the positioning of the cutaway.

DESCRIPTION OF THE PREFERRED EMBODIMENT OF THE INVENTION

Figure 1:
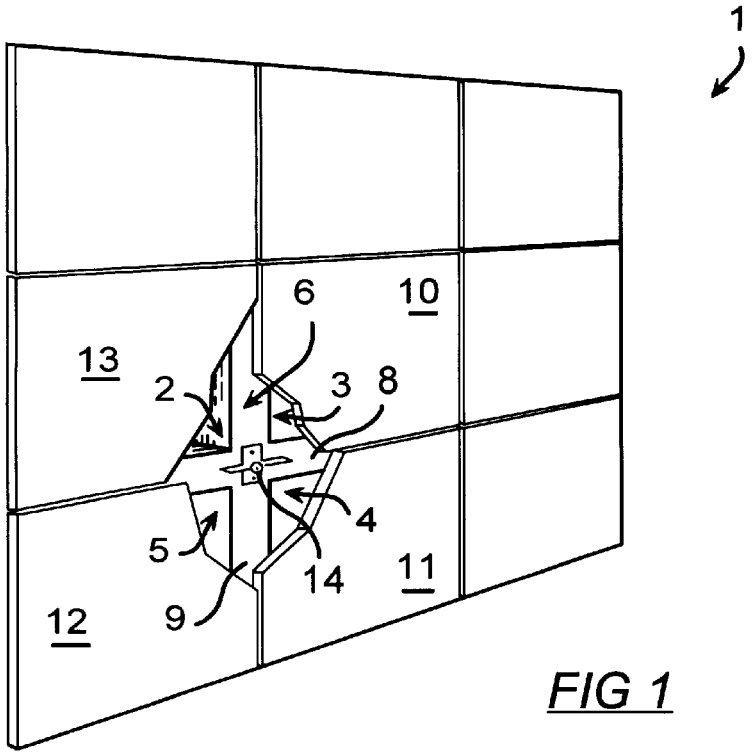
FIG. 1 is a diagrammatic perspective view of a plurality of internment chambers and cover slabs arranged on a vertical support wall.
Figure 2:
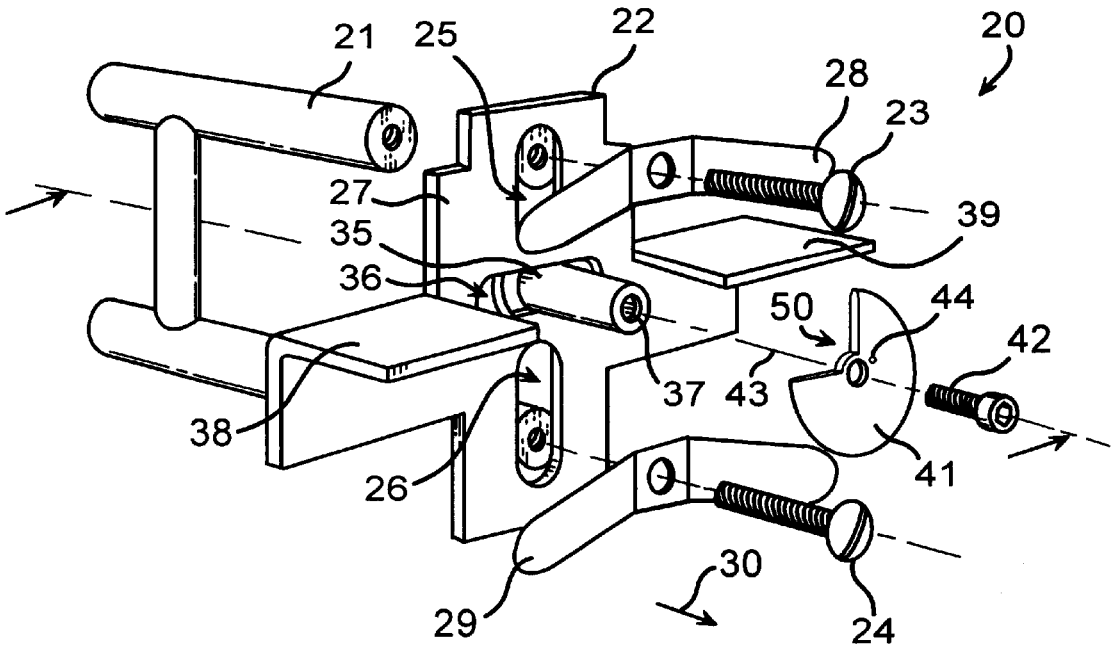
FIG. 2 is an exploded perspective view of a slab fastener according to the invention.
Figure 3:
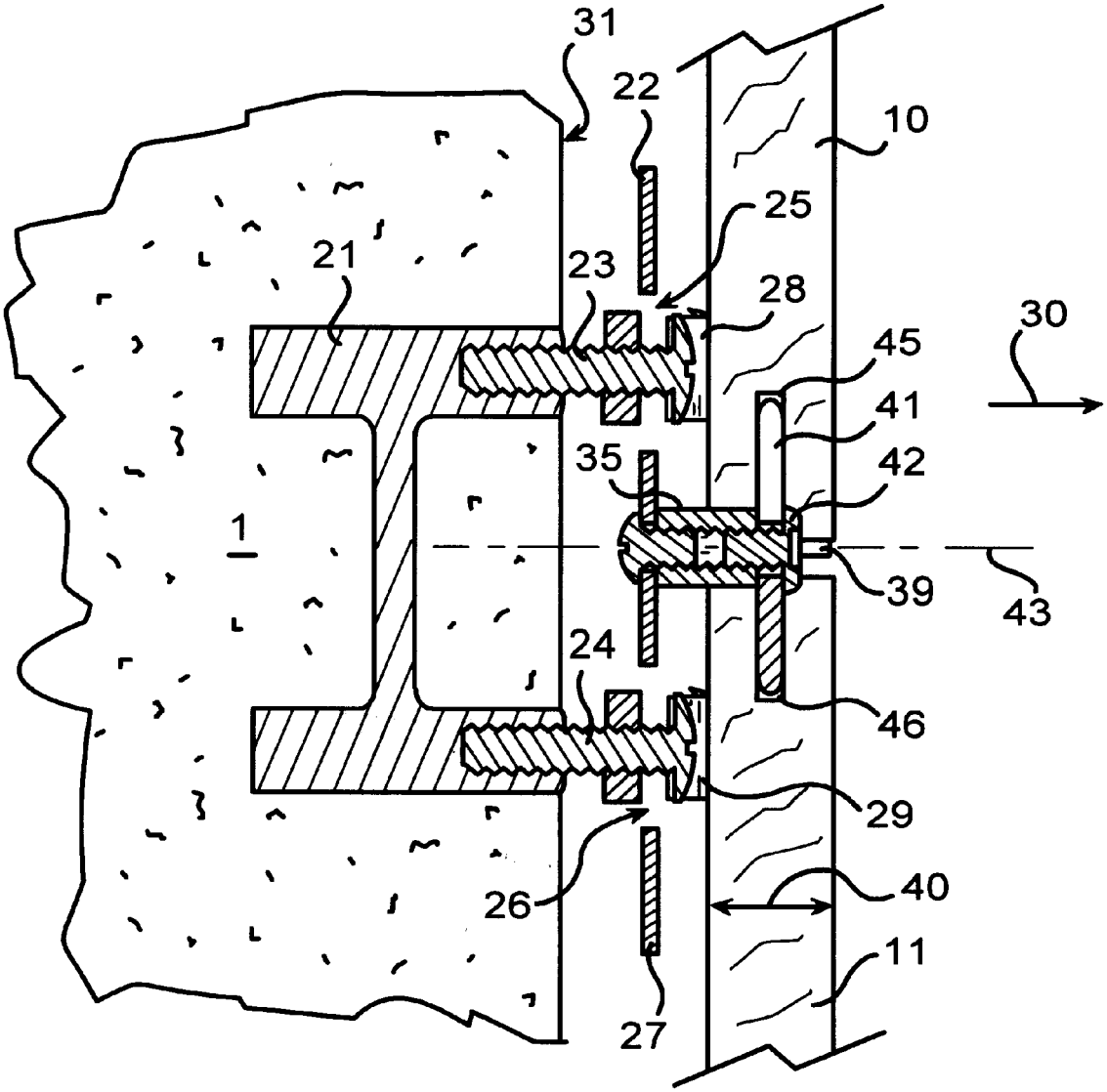
FIG. 3 is a cross-sectional side view of an in-use slab fastener.

Referring now to the drawing, there is shown in FIG. 1 a stationary vertical support structure or wall 1 having a number internment chambers 2, 3, 4, 5 arranged in a roll-and-column fashion divided by a network of horizontal floors 8 and vertical sidewalls 9. Each box-shaped chamber extends horizontally back from the front face 6 of the wall.

Each chamber is covered by a rectangular slab cover 10,11,12,13 made from marble, granite, slate, metal, plastic or other rigid durable sheet material. Each rectangular cover slab is releasably attached to the face of the support structure via slab fasteners placed at its four corners.

A single fastener is located at a point 14 of common adjacency between four corner-adjacent slabs 10–13. In this specification the term "corner-adjacent" is meant to include diagonal adjacency as between slabs 10 and 12, as well as side-by-side, or up-and-down adjacency as in slabs 10 and 11. A single fastener therefore may support a portion of four commonly adjacent slabs.

Referring now to FIGS. 2–6, there is shown a slab fastener 20 for fastening four corner-adjacent rectangular slabs at a common point of adjacency or their four common corners. The fastener comprises an anchor 21 for essentially permanent attachment into the masonry of vertical wall 1 defining the internment chambers. A hanger member 22 made of strong, durable non-corroding material such as brass is semi-permanently attached to the anchor via screws 23,24 through oblong apertures 25,26 in a vertical backing 27, allowing for minor adjustments in the fastener's positioning with respect to the wall. Slab springs 28,29 which serve to bias fastened slabs outward 30 away from the wall, thereby facilitating slab removal, are optionally attached to the hanger member by the screws.

The vertical backing 27 of the hanger member 22 is oriented parallel to the front face 31 of the vertical wall when attached. The backing also supports a central, substantially cylindrical post 35 extending outward perpendicular to the backing. The post has a rear end attached to the backing though a laterally oblong aperture 36 allowing minor lateral adjustment of the point of common adjacency. The post's lateral and vertical location defines the intended point of the common adjacency. The post has a threaded central bore 37 extending rearward from a forward end.

A pair of coplanar support shelves 38,39 extend forward perpendicularly from the backing 27 straddling the post 35. The shelves are located to support the lower sides of the two upper adjacent mounted slabs 13,10. Therefore the plane of the shelves substantially passes through the point of adjacency of the four mounted slabs. The front-to-back dimension of the shelves is less than the thickness 40 of the slabs so as to remain hidden when the slabs are mounted.

A locking plate 41 in the form of a radially eccentric disk made of strong, rigid material such as brass, or stainless steel is rotatively mounted between the support shelves 38,39 on the forward end of the post 35 via an attachment screw 42 engaging the central bore 37. The plate's axis 43 of rotation is therefore coaxial with the bore, and its location is coplanar with the slabs.

Therefore, the length of the post, measured forward to rear is less than the thickness of the slabs, thereby positioning the lock plate between the front and back surfaces of the plate.

The plate is sized and located to engage slots 45–48 extending into the sides of each slab at the corners. The slots may be of various shapes, for example rectangular 45,46, triangular 47, and semi-circular 48, so long as they allow for an amount of angular movement of the plate therein.

The disk has a cutaway 50 sized and dimensioned to allow for the passage of the corner of one of the slabs through the cutaway when the cutaway is rotated into the proper angular orientation. In this way, the disk may be said to be radially eccentric, i.e. the radial distance 51 from the axis 43 out to the edge 52 taken in a first angular direction is different from the distance 53 taken in a different angular direction.

In the preferred approach, the cutaway is substantially semi-circular in shape and is formed by substantially mutually orthogonal sides of the plate forming the cutaway. This shape allows for the substantially rectangular corner of a slab to pass therethrough.

Figure 4:
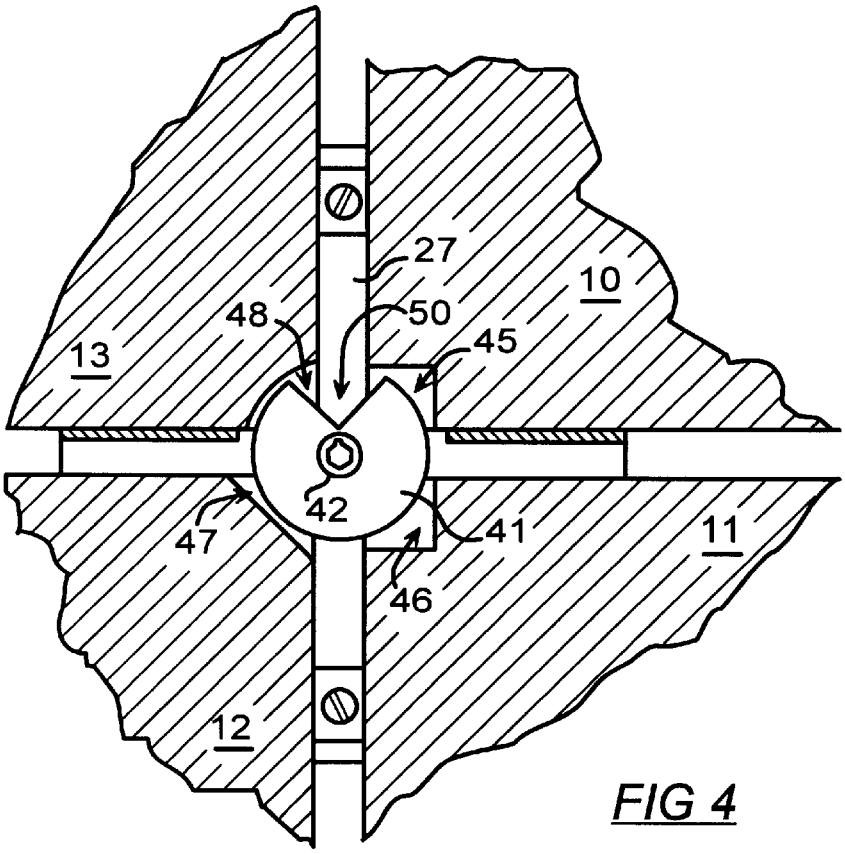
FIG. 4 is a cross-sectional front view of an in-use slab fastener wherein the lock plate is oriented to secure all adjacent slabs.
Figure 5:
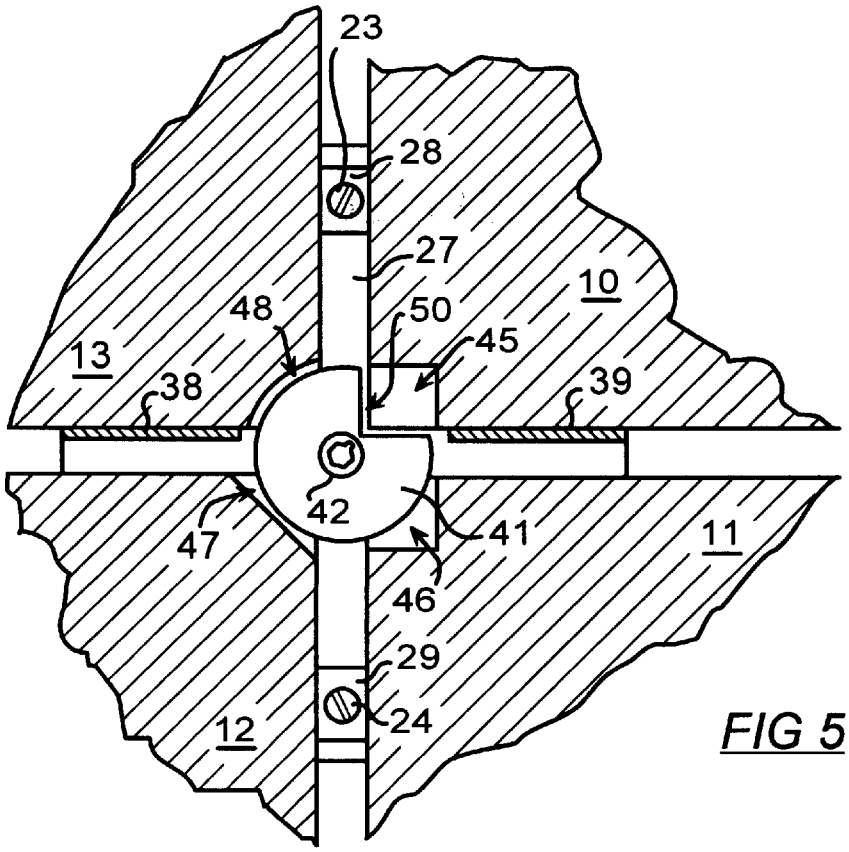
FIG. 5 is a cross-sectional front view of an in-use slab fastener wherein the lock plate is oriented to allow axial removal of a single slab.

A first angular orientation of the plate with respect to the slabs is shown in FIG. 4, where portions of the plate engage the slots of all four slabs preventing axial movement of the slabs. A second angular orientation, shown in FIG. 5, the cutaway 50 is aligned with slab 10 so that no portion of the plate is engaged into slot 45. This allows for the axial passage of the corner of slab 10 through the cutaway and hence, the removal of slab 10.

The screw 42 has an off-axis rearwardly protruding nib sized and located to engage a divot 44 on the front of the disk to provide adequate friction to allow for rotation of the plate by turning the screw. Other means common in the art may be used to rotatively mount the plate on the hanger member, and allow for manipulation of the angular orientation of the plate.

Figure 6:
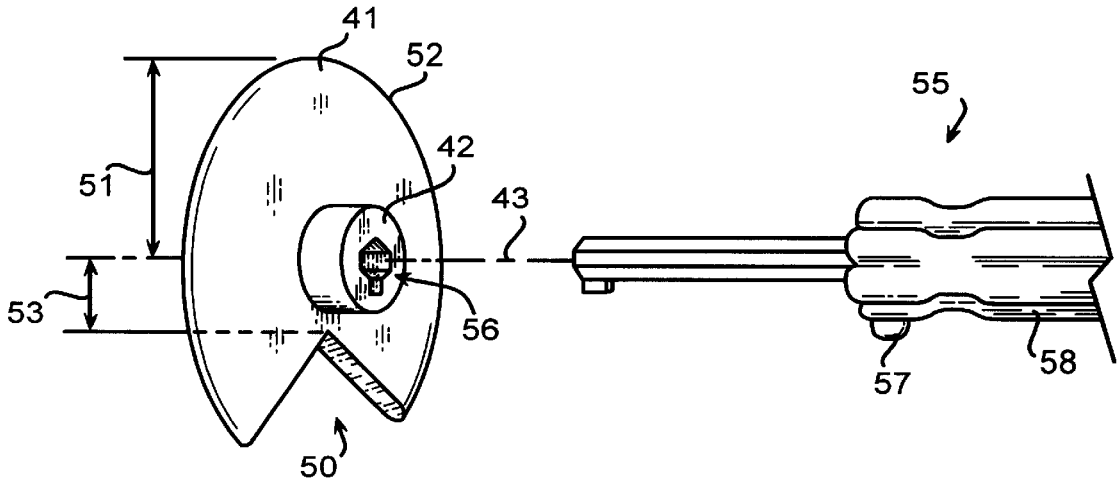
FIG. 6 is a perspective view of the keyed tool for rotating the lock plate while indicating angular orientation.

Referring now to FIG. 6, although a screwdriver or allen-wrench may be used to rotate the plate, the preferred approach uses a keyed tool 55 which engages the keyed hole 56 in the screw 42 in only one angular orientation. An indication in the form or a bump 57 on the handle 58 of the tool signifies the angular orientation of the plate 41.

Figure 7:
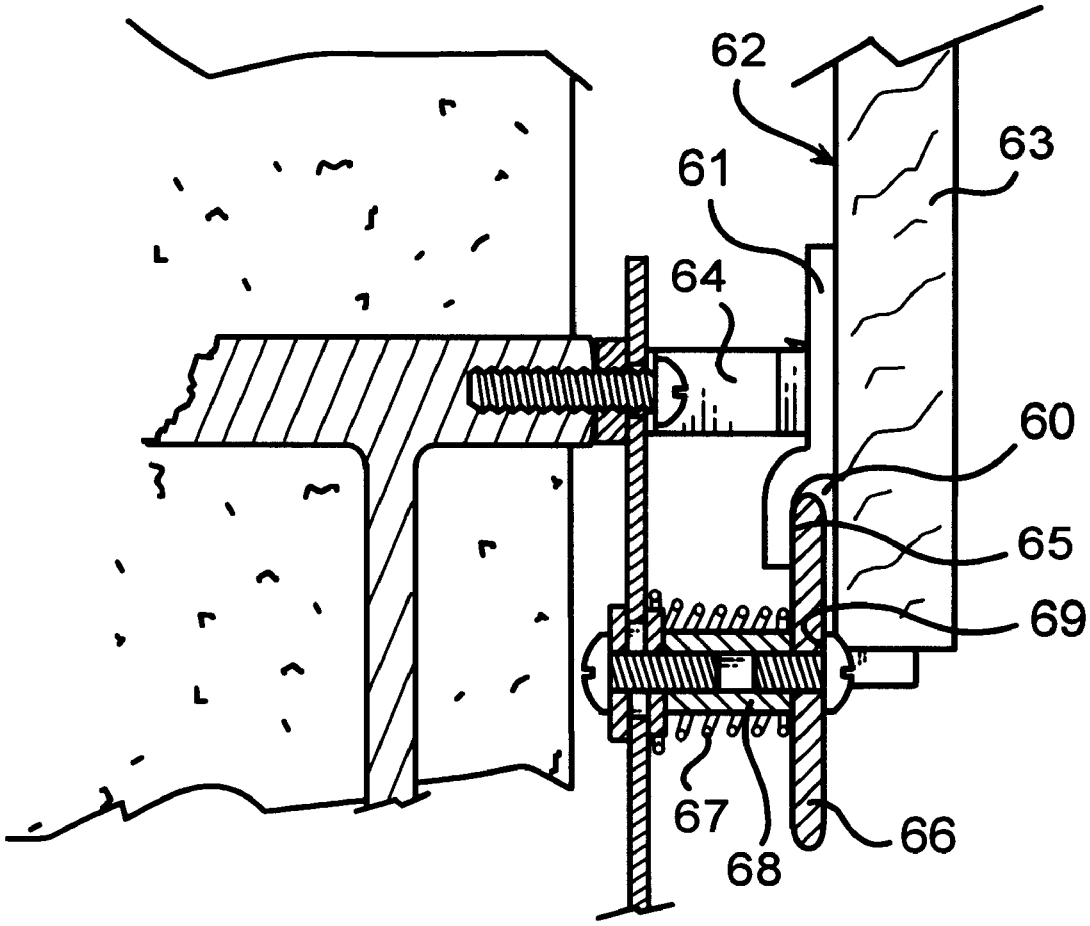
FIG. 7 is a cross-sectional side view of an alternate embodiment in-use slab fastener wherein the slab slots are formed by brackets attached to the back surface of a slab.

In an alternate embodiment of the fastener is shown in FIG. 7 where a slab slot 60 is formed by a bracket 61 attached to the back 62 of a slab 63. In general, the thickness of the slab slots are preferably commensurate with the thickness of the lock plate to maintain front-to-back positioning of the slabs. However, this is not always critical. The slab springs 64 may provide some positioning by forcing the rear face of the slot against the rear surface 65 of the plate 66.

Further, a plate spring 67 concentrically mounted around the post 68 provides for adequate engagement of the screw nib 69 when a simple threaded screw 70 is used to mount the plate 66. This spring also resists angular movement of the plate.

Figure 8:
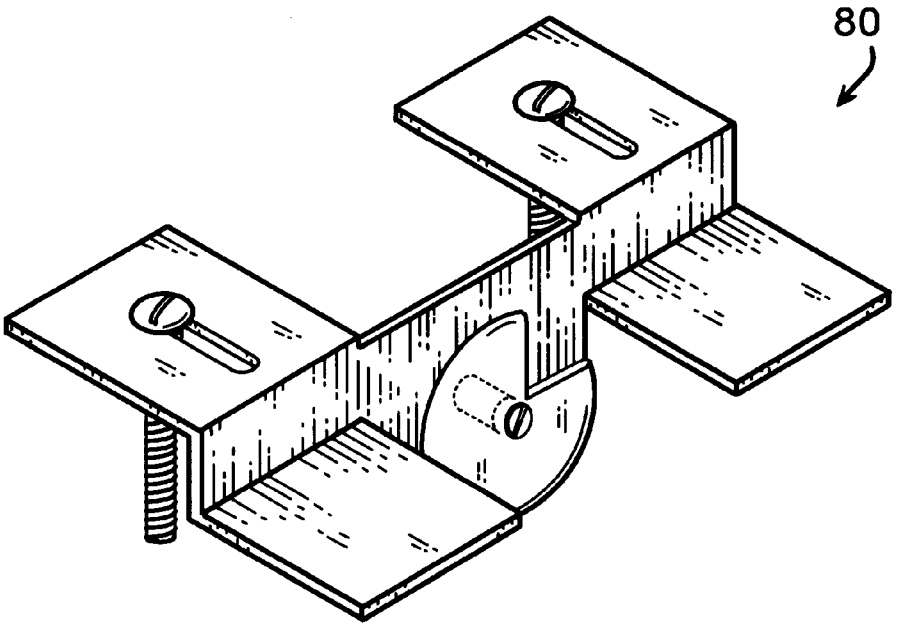
FIG. 8 is a perspective view of an alternate embodiment of the invention adapted to mounting on the top and bottom surfaces of a vertical support wall.
Figure 9:
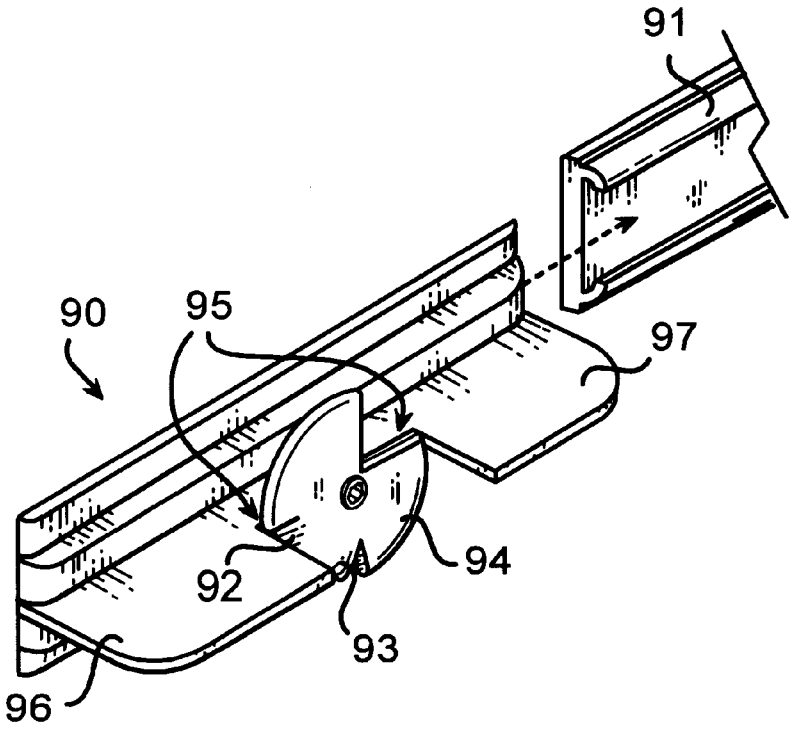
FIG. 9 is a perspective view of an alternate embodiment of the invention adapted to rail based fasteners.

Referring now to FIGS. 8–9, the invention is easily adapted to other fastener designs well known in the art. In FIG. 8, there is shown a fastener 80 according to the invention for securing slabs along the floor and ceiling of the vertical support wall where screws 81,82 engage an anchor extending from a top or bottom ledge.

FIG. 9 shows a fastener 90 according to the invention adapted for use in sliding rail based fastening systems where fasteners are slid into place on C-shaped cross-section tracks 91 mounted to the support wall. In addition, this embodiment shows that portions 92,93 of the plate 94 are bent rearward to form an end-stop to prevent angular movement of the disk beyond two ranges. The bent portions contact sections 95 integral with the slab supporting shelves 96,97. This embodiment of course cannot positively secure more than two side-adjacent slabs.

Although the preferred embodiment shows a fastener for use with four corner adjacent slabs, it is clear to those skilled in the art that minor modifications may be desirable for slabs located at the edge 13 or corner 12 of the wall, as shown in FIG. 1, where a particular corner of a slab may have adjacency with only one other slab, or no adjacency at all. These modifications are discussed in Gallo, U.S. Pat. No. 3,905,169.

Although the preferred embodiment is described with reference to rectangular slabs, it is clear to those skilled in the art that the invention can be adapted to slabs having various other geometrical shapes such as hexagonal.

Although the preferred embodiment allows for total rotational freedom of the plate within the slots, modification of the shape of the plate and/or slots may provide for angular end-stops without departing from the invention.

While the preferred embodiments of the invention have been described, modifications can be made and other embodiments may be devised without departing from the spirit of the invention and the scope of the appended claims.

What is claimed is:

1. A panel fastener combination comprises:

a substantially vertical wall defining a lateral opening of a chamber set therein;

a substantially vertical cover slab having a substantially planar outer surface;

means for releasably securing said cover slab to said wall over said opening;

wherein said means for releasably securing comprise:

a lock plate;

means for rotatively mounting said plate to said wall;

wherein said plate is radially eccentric such that a first angular orientation of said plate engages a portion of said plate into a slot associated with said slab, and a second angular orientation of said plate allows axial removal of said slab;

wherein said means for rotatively mounting are situated entirely behind said outer surface; and wherein said plate has an axis of rotation substantially perpendicular to the vertical plane of said wall;

wherein said means for rotatively mounting comprise:

a hanger member;

a post axially projecting a distance out from a portion of said hanger member, terminating at a distal end; and, said plate being rotatively mounted upon said distal end.

2. The fastener of claim 1, wherein said lock plate comprises a notched disk.

3. The fastener of claim 1, which further comprises means for resisting rotational movement of said plate.

4. The fastener of claim 1, which further comprises means for indicating each of said angular orientations of said lock plate.

5. The fastener of claim 4, wherein said means for indicating comprise:

a keyed slot coaxially associated with said plate having an orientation associated with each of said angular orientations of said plate.

6. A fastener for releasably securing a substantially vertically oriented cover slab having a substantially planar outer surface and at least one edge slot over the lateral opening of a chamber set into a substantially vertical wall, said fastener comprises:

a hanger member for attaching to said wall, said hanger member having a portion for supporting said cover slab;

a post axially horizontally projecting a distance out from a portion of said hanger member, terminating at a distal end;

a radially eccentric lock plate having an angular notch, said plate being rotatively mounted upon said distal end, and said plate being sized and dimensioned for engaging said slot.

7. The fastener of claim 6, wherein said plate has an axis of rotation which is substantially horizontal.

8. The fastener of claim 6, wherein said lock plate comprises a notched disk.

9. The fastener of claim 6, which further comprises means for resisting rotational movement of said plate.

10. The fastener of claim 6, which further comprises means for indicating each of said angular orientations of said lock plate.

11. The fastener of claim 10, wherein said means for indicating comprise:

a keyed slot coaxially associated with said plate having an orientation associated with each of said angular orientations of said plate.

* * * * *